United States Patent [19]

Tyler

[11] 3,967,533

[45] July 6, 1976

[54] SERVO VALVE CONTROL APPARATUS

[75] Inventor: Henry P. Tyler, South Bend, Ind.

[73] Assignee: The Bendix Corporation, South Bend, Ind.

[22] Filed: Dec. 23, 1974

[21] Appl. No.: 535,904

[52] U.S. Cl. ..... 91/49; 91/382; 91/416

[51] Int. Cl.[2] ..... F15B 9/10; F15B 15/17

[58] Field of Search ..... 91/49, 382, 416

[56] References Cited

UNITED STATES PATENTS

| | | | |
|---|---|---|---|
| 2,824,548 | 2/1958 | Roch et al. | 91/382 |
| 3,139,922 | 7/1964 | Peczkowski | 91/49 |
| 3,491,652 | 1/1970 | Riggs | 91/382 |
| 3,713,366 | 1/1973 | McCombs | 91/382 |

FOREIGN PATENTS OR APPLICATIONS

| | | | |
|---|---|---|---|
| 249,633 | 2/1964 | Australia | 91/49 |

*Primary Examiner*—Paul E. Maslousky
*Attorney, Agent, or Firm*—Gordon H. Chenez; William N. Antonis

[57] ABSTRACT

A fluid servo network having a servo fluid pressure responsive movable output member controlled by a variable area orifice the effective area of which is established by a movable servo valve which is actuated by lever means in response to a variable force input applied thereto. The lever means includes a main input lever responsive to the variable force input and an opposing variable feedback force which varies in response to the reaction of the output member to establish a force balance on the main input lever. The main input lever is attached to a roller loaded by a constant reference force and movable along a secondary lever mounted for pivotal movement about a fixed axis to vary the effective lever arm of the secondary lever which is attached to the servo valve. The input torque tending to close the servo valve is opposed by the torque derived from a characteristic orifice force unbalance acting through the secondary lever. The forces acting on the secondary lever are isolated from the main input lever thereby making the size and rate of the variable area orifice independent of the force balance relationship of the main input lever.

10 Claims, 3 Drawing Figures

SERVO VALVE CONTROL APPARATUS

SUMMARY OF THE INVENTION

A fluid servo network wherein a characteristic force unbalance or rate imposed on a fluid servo valve as a result of servo orifice area variations is effectively isolated from an input force actuated lever which establishes servo valve position.

It is an object of the present invention to provide a force balance fluid servo control wherein a characteristic force unbalance generated across a servo valve is isolated from the force balance network.

DESCRIPTION OF THE PREFERRED EMBODIMENT

Figure 1:
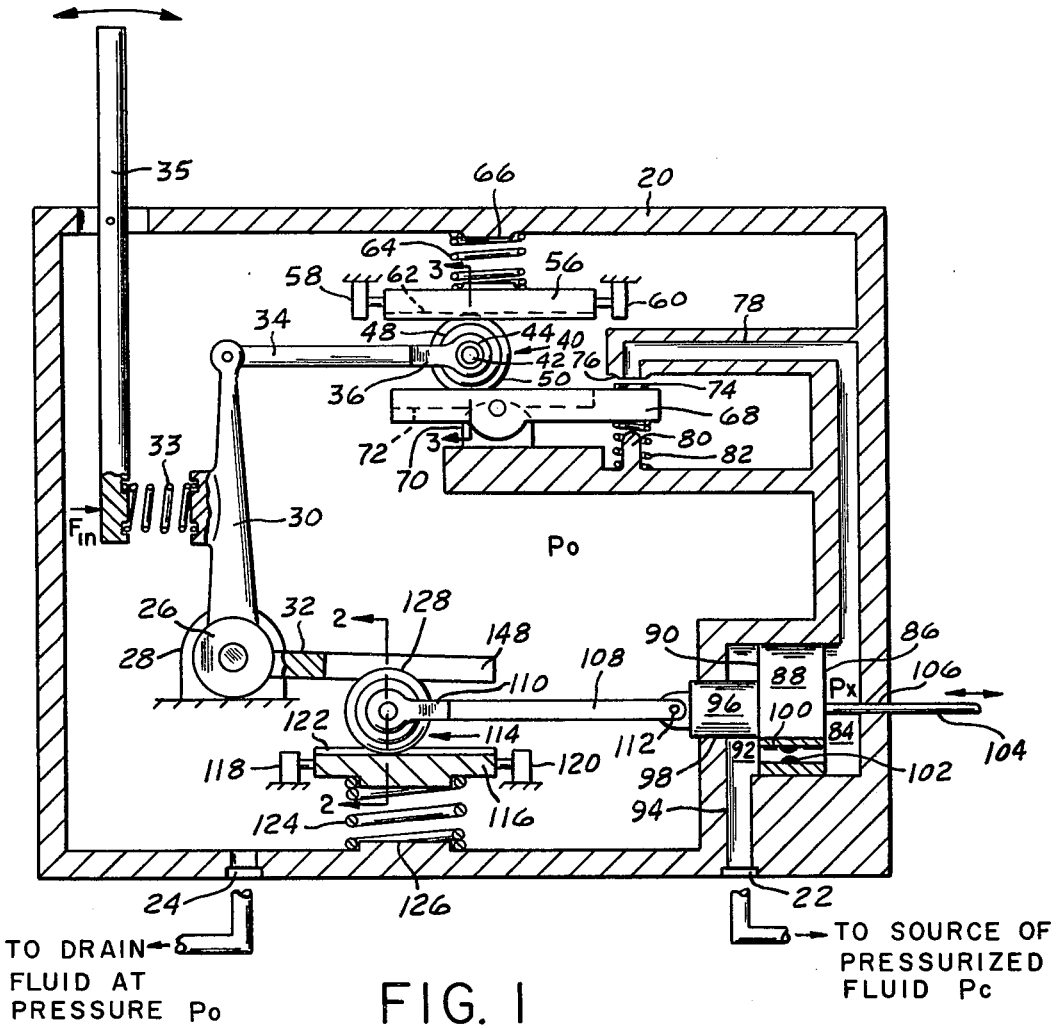
FIG. 1 is a schematic drawing of a force balance fluid servo system embodying the present invention.
Figure 2:
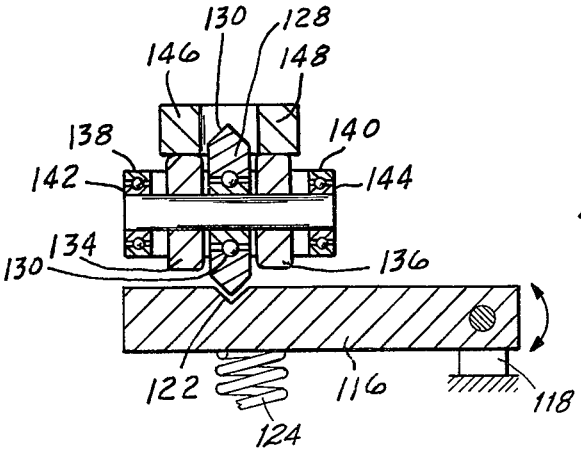
FIG. 2 is a schematic sectional view taken on line 2—2 of FIG. 1.
Figure 3:
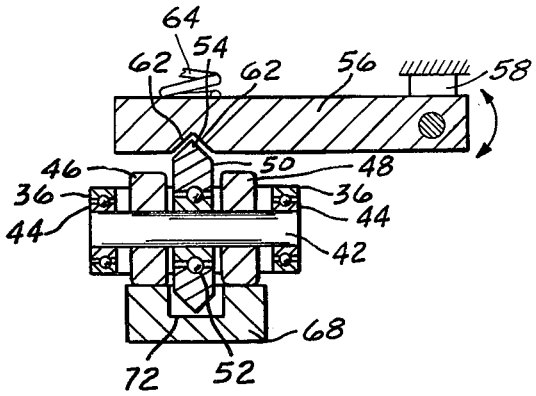
FIG. 3 is a schematic sectional view taken on line 3—3 of FIG. 1.

Referring to the drawings, numeral 20 designates a casing having an inlet 22 connected to a source of pressurized fluid preferably at a constant pressure $P_c$, not shown, and an outlet 24 connected to vent the interior of casing 20 to a suitable source of drain fluid at a relatively low pressure $P_o$ compared to $P_c$, not shown.

The casing 20 houses a main input lever 26 pivotally mounted on a fixed support 28 and provided with an arm portion 30 and a bifurcated arm 32. An input spring load, $F_{in}$, is applied to lever 26 by a compression spring 33 which bears against a control lever 35 pivotally secured to casing 20 and movable to vary the spring load imposed against lever 26. An arm 34 having a bifurcated end portion or yoke 36 is pivotally secured at an opposite end 38 to arm 30. A roller assembly 40 is mounted on a shaft 42 which, in turn, is rotatably secured to yoke 36 by suitable anti-friction bearings 44. The roller assembly 40 includes spaced apart rollers 46 and 48 fixedly secured to shaft 42 and separated by a roller 50 rotatably secured to shaft 42 by an antifriction bearing 52 and provided with a V-shaped peripheral edge 54. A plate 56 pivotally mounted to spaced apart fixed supports 58 and 60 bears against roller 50 and is provided with a V-shaped track or groove 62 along which the roller 50 is adapted to roll. The track or groove 62 is parallel to the pivot axis of plate 56. A compression spring 64 interposed between a fixed support 66 and the plate 56 provides a reference force which is imposed against roller 50. The rollers 46 and 48 bear against a lever 68 pivotally secured to a fixed support 70 and provided with a recessed portion 72 providing clearance for roller 50 relative to the lever 68. A valve flapper 74 fixedly secured to lever 68 is adapted to coact with a valve orifice 76 at the discharge end of a passage 78 to thereby vary the effective flow area of the latter. A fixed stop 80 limits movements of lever 68 and thus flapper 74 away from orifice 76. A compression spring 82 may bear against lever 68 thereby imposing a relatively light force preload tending to urge flapper against orifice 76.

The passage 78 is connected to a variable volume chamber 84 which, in part, is defined by a face 86 of a stepped diameter piston 88 slidably carried by casing 20. An opposite relatively smaller area face 90 of piston 88 defines, in part, a variable volume chamber 92 connected via a passage 94 to receive pressurized fluid $P_c$ from inlet 22. A reduced diameter section 96 of piston 88 slidably extends through an opening 98 in casing 20 and is exposed to the interior of casing 20 at drain pressure $P_o$. The opposite faces 86 and 90 communicate via a passage 100 in piston 88 which passage 100 is provided with a flow restriction 102. A rod or stem 104 fixedly secured to piston 88 extends therefrom through an opening 106 in casing 20 to provide an output position signal externally of casing 20.

An arm 108 having a bifurcated end portion or yoke 110 is pivotally secured at its opposite end to reduced diameter section 96 by a pin 112. A roller assembly 114, similar to roller assembly 40, is attached to yoke 110 and adapted to engage bifurcated arm 32 and a plate 116. The plate 116 is pivotally mounted to spaced apart fixed supports 118 and 120 and, like plate 56, is provided with a V-shaped track or groove 122 which extends parallel to the pivot axis of plate 116. A compression spring 124 interposed between plate 116 and a fixed support 126 provides a reference force which is imposed against intermediate roller 128 of roller assembly 114. The roller 128 is provided with a V-shaped peripheral edge 130 which rides in track or groove 122. The roller 128 is rotatably carried via anti-friction bearing 130 on a shaft 132 upon which spaced apart rollers 134 and 136 are fixedly secured. The shaft 132 is rotatably secured to arms 138 and 140 of yoke 110 by antifriction bearings 132 and 144, respectively. The spaced apart rollers 134 and 136 ride against spaced apart arm portions 146 and 148, respectively, of bifurcated arm 32.

It will be understood that the pivot axis of main input lever 26 is arranged to be perpendicular to the pivot axis of plate 116. Likewise, the pivot axis of lever 68 is arranged to be perpendicular to the pivot axis of plate 56.

In operation, pressurized fluid $P_c$ is supplied to inlet 22 thereby filling chamber 92 from which fluid flows through restriction 102 to chamber 84 and then through passage 78 and orifice 76 to the interior of casing 20 at drain pressure $P_o$. The position of flapper 74 determines the flow area of orifice 76 and thus controlled pressure $P_x$ in chamber 84. Assuming stable conditions, the piston 88 will occupy a position dictated by the position of control lever 35. The lever 26 is balanced by equal and opposite torque loads derived from input force $F_{in}$ and spring 124, respectively, acting through the respective lever arms of lever 26. The flapper 74 occupies a null position by virtue of equal and opposite torque loads imposed on lever 68 wherein the combined torque derived from spring loaded roller assembly 40 and spring 82 acting through the respective lever arms equals the opposing torque derived from the pressure drop $P_x$-$P_o$ acting against the effective area of flapper 74 and applied through the associated lever arm of lever 68.

Now, assuming the control lever 35 to be actuated in a counterclockwise direction to thereby increase the spring load $F_{in}$ applied to main input lever 26, the lever 26 will be unbalanced in a clockwise direction as viewed in FIG. 1 against the opposing force of spring 124. The roller assembly 40 is actuated toward the pivot axis of lever 68 thereby decreasing the effective lever arm of the lever 68 through which the force imposed by rollers 46 and 48 acts which, in turn, unbalances lever 68 in a clockwise direction tending to move flapper 74 away from orifice 76 and increase the flow area of the latter accordingly. The resulting movement of piston 88 to the right in response to the decrease in pressure $P_x$ causes the roller assembly 114 attached thereto to move away from the pivot axis of input lever 26 thereby increasing the effective lever arm of arm 32 through which the force imposed by rollers 134 and 136 acts resulting in a feedback torque equal to the input torque derived from $F_{in}$ acting through arm 30 which stabilizes the lever 26. The flapper 74 normally occupies a null position and is adapted to operate within a relatively small range of movement therefrom in either direction to cause movement of piston 88 as described above.

It will be recognized that the isolation of the characteristic orifice force unbalance imposed against flapper 74 as a result of the $P_x$-$P_o$ pressure drop across orifice 76 results in improved accuracy of the position of piston 88 relative to the input force, $F_{in}$. The orifice 74 may be made larger to improve the slew velocity of piston 88 and/or orifice gain characteristic without undesirable load effects on lever 26 resulting in better response and accuracy of the system as will be recognized by those skilled in the art.

I claim:

1. In a servo system the combination of:

conduit means connecting a source of pressurized fluid with a relatively lower pressure source;

valve means having a characteristic force unbalance imposed thereon operatively connected to said conduit means for controlling fluid flow therethrough to generate a controlled fluid pressure;

movable output means responsive to said controlled pressure for producing an output signal;

first lever means pivotally mounted on a first axis and responsive to an input force imposed thereon;

feedback means including a first reference force generating means operatively connected to said movable output means and said first lever means for imposing a force against said first lever means in opposition to said input force in response to movement of said movable output means to establish a balanced condition of said first lever means;

second lever means pivotally mounted on a second axis and operatively connected to said valve means for actuating the same in opposition to said characteristic force unbalance imposed thereon;

second reference force generating means; and force transmitting means operatively connected to said first lever means and said second reference force generating means and said second lever means for imposing said second reference force at various points along said second lever means in response to the position of said first lever means to establish a balanced condition of said second lever means.

2. In a servo system as claimed in claim 1 wherein:

said conduit means includes first and second fluid flow restrictions in series flow relationship;

said valve means is a valve member engageable with said second restriction to vary the effective flow area thereof and thus the fluid pressure drop across said first restriction; and said movable output means is responsive to the pressure drop across said first restriction.

3. In a servo system as claimed in claim 1 wherein:

said first lever means is mounted on a fixed support and provided with first and second arm portions;

said input force acts through said first lever arm portion and said reference force acts through said second arm portion in opposition to said input force.

4. In a servo system as claimed in claim 1 wherein:

said second lever means is mounted on a fixed support and provided with first and second lever arm portions;

said second reference force generating means includes a plate member pivotally mounted on fixed support means and a compression spring bearing against said plate member; and said force transmitting means includes roller means operatively engaged with said plate member and said second lever means.

5. In a servo system as claimed in claim 4 wherein:

said plate member is pivoted on an axis perpendicular to the second pivot axis of said second lever means.

6. In a servo system as claimed in claim 1 wherein:

said valve means has a null position in response to a balanced condition of said second lever means.

7. In a servo system as claimed in claim 2 wherein:

said movable output means is a stepped diameter piston having a first effective area exposed to the pressurized fluid upstream from said first restriction and a second relatively larger effective area exposed to the pressurized fluid downstream from said first restriction.

8. In a servo system as claimed in claim 1 wherein:

said first force generating means and said second force generating means each include a plate member pivotally mounted on fixed support means and a compression spring bearing against said plate member;

said plate members being pivotable about their respective axes which are perpendicular to said first and second axes of said first and second lever means, respectively.

9. In a servo system as claimed in claim 8 wherein:

said first reference force is constant regardless of the position of said force transmitting means along said second lever means.

10. In a servo system as claimed in claim 8 wherein:

said first reference force and said second reference force are constant.

* * * * *